US010760474B2

(12) United States Patent
Lee

(10) Patent No.: US 10,760,474 B2
(45) Date of Patent: Sep. 1, 2020

(54) CONTROL METHOD FOR COOLING SYSTEM

(71) Applicants: Hyundai Motor Company, Seoul (KR); Kia Motors Corporation, Seoul (KR)

(72) Inventor: Yonggyu Lee, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 31 days.

(21) Appl. No.: 16/198,137

(22) Filed: Nov. 21, 2018

(65) Prior Publication Data

US 2020/0063640 A1 Feb. 27, 2020

(30) Foreign Application Priority Data

Aug. 22, 2018 (KR) ..... 10-2018-0098122

(51) Int. Cl.
*F01P 11/16* (2006.01)
*F01P 3/02* (2006.01)
*F01P 7/16* (2006.01)

(52) U.S. Cl.
CPC ..... *F01P 11/16* (2013.01); *F01P 3/02* (2013.01); *F01P 7/16* (2013.01); *F01P 2003/028* (2013.01); *F01P 2025/32* (2013.01); *F01P 2025/50* (2013.01)

(58) Field of Classification Search
CPC ..... F01P 11/16; F01P 3/02; F01P 7/16; F01P 2003/028; F01P 2025/32; F01P 2025/50; F02D 41/402; F02D 41/04
See application file for complete search history.

(56) References Cited

U.S. PATENT DOCUMENTS

| | | | | |
|---|---|---|---|---|
| 6,532,807 | B1 * | 3/2003 | Krauss | F01P 7/16 73/114.68 |
| 2013/0160723 | A1 * | 6/2013 | Miyagawa | F01P 7/16 123/41.1 |
| 2014/0379237 | A1 * | 12/2014 | Rodriguez | F02D 41/064 701/103 |
| 2018/0051620 | A1 * | 2/2018 | Lee | F02M 26/32 |
| 2019/0186337 | A1 * | 6/2019 | Insixiengmai | F01P 7/14 |

* cited by examiner

*Primary Examiner* — Syed O Hasan
(74) *Attorney, Agent, or Firm* — Mintz Levin Cohn Ferris Glovsky and Popeo, P.C.; Peter F. Corless

(57) ABSTRACT

A control method for a cooling system is provided. The method includes determining whether the output signals of a first coolant temperature sensor and a second coolant temperature sensor satisfy a predetermined coolant overheating condition. A coolant control valve unit is operated to move the cam to a maximum position when the predetermined coolant overheating condition is satisfied. Additionally, a control temperature is determined according to an output signal of the first coolant temperature sensor and the second coolant temperature sensor and an operation of the injector is limited according to the determined control temperature.

14 Claims, 7 Drawing Sheets

FIG. 7

| T_max [℃] | 120 | 125 | 130 | 135 | 140 | 145 |
|---|---|---|---|---|---|---|
| Limit torque [Nm] | 100% | 80% | 60% | 40% | 20% | 10% |

CONTROL METHOD FOR COOLING SYSTEM

CROSS-REFERENCE TO RELATED APPLICATION

This application claims priority to and the benefit of Korean Patent Application No. 10-2018-0098122 filed on Aug. 22, 2018, the entire contents of which are incorporated herein by reference.

BACKGROUND

(a) Field of the Invention

The present invention relates to a cooling system control, and more particularly, to a method for controlling a cooling system that prevents coolant boiling and the like.

(b) Description of the Related Art

One developed the integrated heat management technologies is a separation cooling technique which improves the fuel efficiency by independently adjusting a coolant temperature of a cylinder head and an engine block. Mainly, a temperature of the cylinder head is maintained in low temperature to reduce NOx generation and knocking, and a temperature of the engine block is maintained in high temperature and thus, fuel efficiency may be improved.

Even when separate cooling is applied, the coolant boiling point is the same since the cooling system uses one loop. Therefore, the temperature of the coolant of the engine block may increase thus causing boiling to occur which may damage the heat exchange element or the engine.

The above information disclosed in this section is merely for enhancement of understanding of the background of the invention and therefore it may contain information that does not form the prior art that is already known in this country to a person of ordinary skill in the art.

SUMMARY

The present invention provides a control method of a cooling system capable of preventing coolant boiling and the like. In particular, the present invention provides a control method for preventing coolant boiling in an engine block of a cooling system that independently adjusts coolant of a cylinder head and an engine block.

A control method according to an exemplary embodiment of the present invention may be applied to a cooling system including a coolant control valve unit having a cam which adjusts opening rates of a first coolant passage through which the coolant distributed to a heater flows, a second coolant passage through which the coolant distributed to a radiator flows and a third coolant passage through which the coolant discharged from a cylinder block flows, a vehicle operation state detecting portion having a first coolant temperature sensor configured to measure the temperature of the coolant flowing through the cylinder head and output a corresponding signal, a second coolant temperature sensor configured to measure the temperature of the coolant flowing through the cylinder block, a position sensor configured to sense a rotation of the cam and outputting a corresponding signal, an injector and a controller configured to operate the coolant control valve unit and the injector based on output signals of the vehicle operation state detecting portion.

The control method may include determining, by the controller, whether the output signals of the first coolant temperature sensor and the second coolant temperature sensor satisfy a predetermined coolant overheating condition, operating the coolant control valve unit to move the cam to a maximum position when the predetermined coolant overheating condition is satisfied, determining a control temperature based on an output signal of the first coolant temperature sensor and the second coolant temperature sensor and limiting an operation of the injector based on the determined control temperature.

The maximum position may be a position where the first coolant passage and the third coolant passage are fully opened. The controller may be configured to determine a first correction temperature and a second correction temperature by subtracting a first and second offset values from the output signals of the first coolant temperature sensor and the second coolant temperature sensor respectively and then compare the first and second correction temperatures and set a greater correction temperature to the control temperature.

The operation limitation of the injector may be performed by applying the control temperature to a predetermined table. The coolant control valve unit may be equipped with a fail-safe thermostat for selectively discharging coolant to the radiator. The fail-safe thermostat may be an electrical thermostat and the control method may further include opening the fail-safe thermostat by operating the fail-safe thermostat when the coolant overheating condition is satisfied.

The moving of the cam to the maximum position may be performed by the controller configured to output the movement signal of the cam for a predetermined period of time. The control method of the cooling system according to the exemplary embodiment of the present invention may prevent the coolant boiling of the cooling system to which the engine for independently adjusting the coolant temperature of the cylinder head and the engine block is applied.

BRIEF DESCRIPTION OF THE DRAWINGS

The above and other objects, features and other advantages of the present invention will be more clearly understood from the following detailed description when taken in conjunction with the accompanying drawings, in which:

FIG. 7 is a torque limiting table that may be applied to a control method according to the exemplary embodiment of the present invention.

DESCRIPTION OF SYMBOLS

10: vehicle operation state detecting portion

12: first coolant temperature sensor

Figure 1:
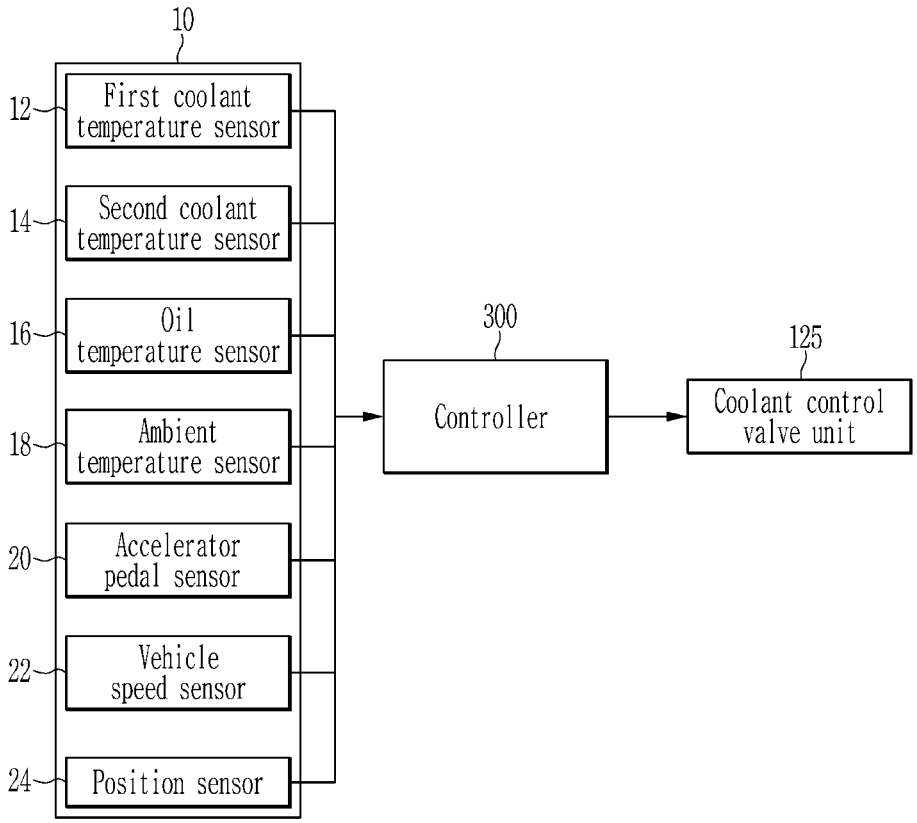
FIG. 1 is a block diagram of a control system applicable to a control method according to an exemplary embodiment of the present invention.

14: second coolant temperature sensor
16: oil temperature sensor
18: ambient temperature sensor
20: accelerator pedal sensor
22: vehicle speed sensor
24: position sensor
90: engine
100: engine block
105: cylinder head
110: LP-EGR cooler
115: heater
125: coolant control valve unit
130: radiator
135: oil cooler
140: oil control valve
145: HP-EGR valve
155: coolant pump
210: cam
215*a*: first rod
215*b*: second rod
215*c*: third rod
220: valve
220*a*: first valve
220*b*: second valve
220*c*: third valve
225*a*: first elastic member
225*b*: second elastic member
225*c*: third elastic member
230*a*: first coolant passage
230*b*: second coolant passage
230*c*: third coolant passage
300: controller
305: motor
310: gear box
320*a*: first track
320*b*: second track
320*c*: third track
330: fail-safe thermostat
340: injector

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

Furthermore, control logic of the present invention may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, an exemplary embodiment of the present invention will be described in detail with reference to the accompanying drawings. However, the size and thickness of each component illustrated in the drawings are arbitrarily shown for ease of description and the present invention is not limited thereto, and the thicknesses of portions and regions are exaggerated for clarity.

In addition, parts that are irrelevant to the description are omitted to clearly describe the exemplary embodiments of the present invention, and like reference numerals designate like elements throughout the specification. In the following description, dividing names of components into first, second, and the like is to divide the names because the names of the components are the same, and an order thereof is not particularly limited.

Figure 2:
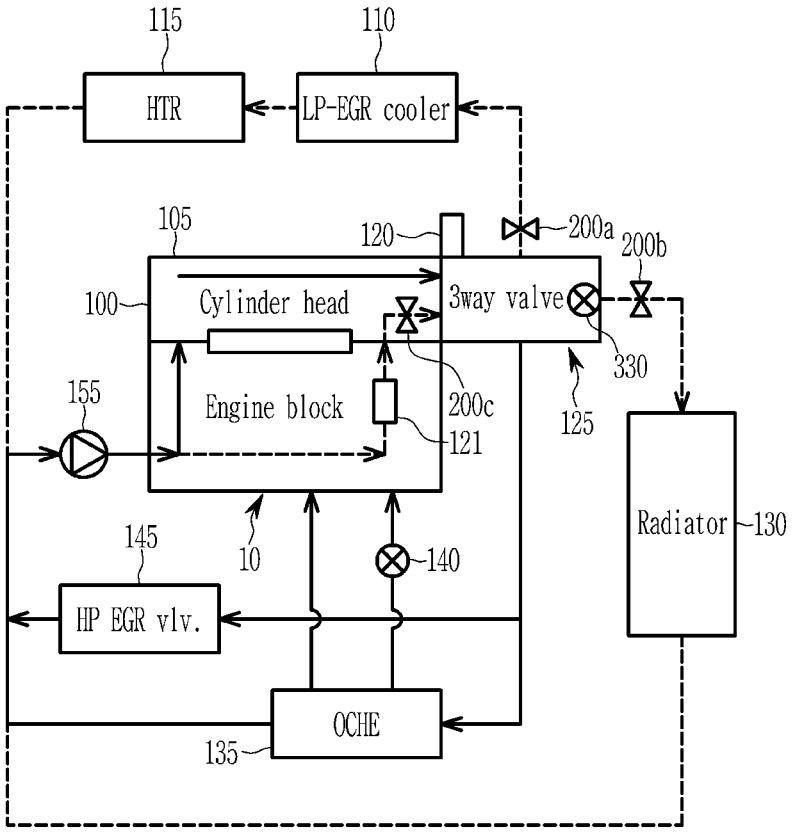
FIG. 2 is a schematic diagram of a control system applicable to a control method according to an exemplary embodiment of the present invention.

FIG. 1 is a block diagram of a control system applicable to a control method according to an exemplary embodiment of the present invention and FIG. 2 is a schematic diagram of a control system applicable to a control method according to an exemplary embodiment of the present invention. Referring to FIG. 1 and FIG. 2, a cooling system according to an exemplary embodiment of the present invention may include a controller 300 configured to operate a coolant control valve unit 125 and an injector 340 based on an output signal of the vehicle operation state detecting portion 10.

The vehicle operation state detecting portion 10 may include a first coolant temperature sensor 12, a second coolant temperature sensor 14, an oil temperature sensor 16 configured to detect engine oil temperature and output a corresponding signal, an ambient temperature sensor 18 configured to detect ambient air temperature and output a corresponding signal, an accelerator pedal sensor 20 configured to detect an operation angle of an accelerator pedal and output a corresponding signal, a vehicle speed sensor 22 configured to detect a speed of a vehicle and output a corresponding signal and a position sensor 24.

The controller 300 may be implemented as one or more microprocessors operating by a predetermined program, and the predetermined program may include a series of commands for performing the exemplary embodiment of the present invention. The cooling system which may be applied to a control system according to an exemplary embodiment of the present invention may include an engine 90 having an engine block 100 and a cylinder head 105, an low pressure-exhaust gas recirculation (LP-EGR) cooler 110, a heater 115, a radiator 130, an oil cooler 135, an oil control valve 140, a high pressure-exhaust gas recirculation (HP-EGR) valve 145 and a coolant pump 155.

The coolant pump 155 may be configured to pump the coolant to a coolant inlet side of the engine block 100 and the pumped coolant may be distributed to the engine block 100 and the cylinder head 105. The coolant control valve unit 125 may be configured to receive the coolant from the cylinder head 105 and adjust an opening rate of a coolant outlet side coolant passage of the engine block 100. The first coolant temperature sensor 12 configured to sense the temperature of the coolant exhausted from the cylinder head 105 may be disposed on the coolant control valve unit 125. The second coolant temperature sensor 14 configured to sense the temperature of the coolant exhausted from the engine block 100 may be disposed on the engine block 100.

The coolant control valve unit 125 may be configured to respectively adjust the coolant flow distributed to the heater 115 and the radiator 130. In particular, the coolant may pass through the low pressure EGR cooler 110 before passing through the heater 115, and the heater 115 and the low pressure EGR cooler 110 may be disposed in series or in parallel. The heater 115 may not be limited to an element for heating inside of a vehicle. In other words, the heater 115 in detailed description and claims may be a heater, an air conditioner, or a heating, ventilation and air conditioning (HVAC) and so on. The coolant control valve unit 125 may be configured to always supply the coolant to the HP-EGR valve 145 and the oil cooler 135.

Additionally, a part of engine oil circulated along the engine block 100 and the cylinder head 105 may be cooled while circulating the oil cooler or oil coolant heat exchanger 135, and the oil control valve 140 may be disposed between the engine 90 and the oil cooler or oil coolant heat exchanger 135 to adjust the flow of the oil. The coolant control valve unit 125 may further include a fail-safe thermostat 330 for selectively discharging coolant to the radiator 130. The fail-safe thermostat 330 may be an electric thermostat, and the controller 300 may be configured to operate the fail safe thermostat 330. The structure and function of the components according to the exemplary embodiment of the present invention are well known in the art, and detailed description thereof will be omitted.

Figure 3:
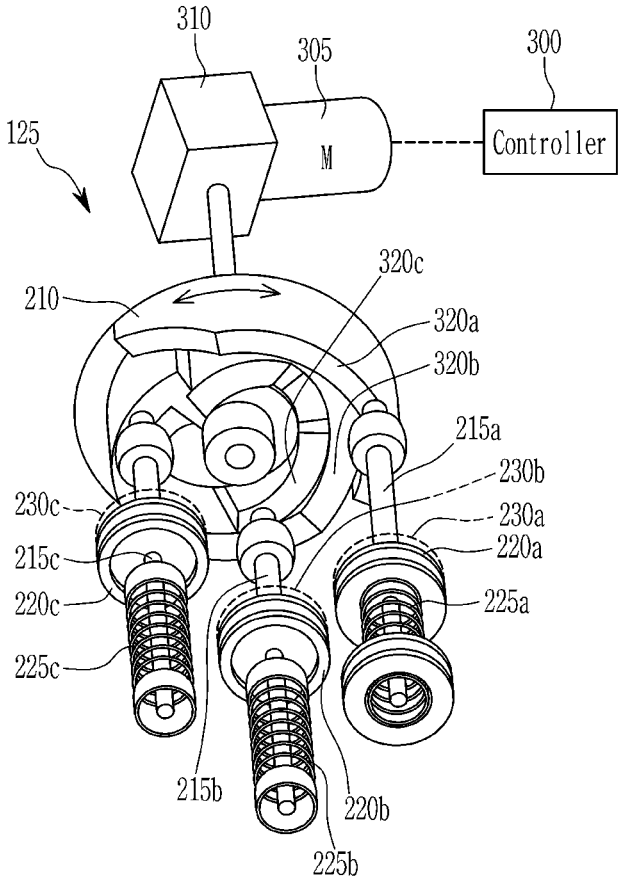
FIG. 3 is a partial detailed perspective view of a coolant control valve unit of a control system applicable to a control method according to an exemplary embodiment of the present invention.

FIG. 3 is a partial detailed perspective view of a coolant control valve unit of a control system applicable to a control method according to an exemplary embodiment of the present invention. Referring to FIG. 3, the coolant control valve unit 125 may include a cam 210, tracks formed to the cam 210, rods that contact the tracks, valves connected with the rods and elastic members biasing the valves and the valves may close coolant passages.

A plurality of tracks, for example, a first track 320*a*, a second track 320*b*, and a third track 320*c*, each having a predetermined inclination and height, and a plurality of rods, for example, a first rod 215*a*, a second rod 215*b*, and a third rod 215*c*, may be disposed in a lower portion of the cam 210 such that the first, second, and third rods 215*a*, 215*b*, and 215*c* that respectively contact the first, second, and third tracks 320*a*, 320*b*, and 320*c* may move downward based on a rotation position of the cam 210. In addition, the elastic member may include three elastic members, i.e., a first elastic member 225*a*, a second elastic member 225*b*, and a third elastic member 225*c* to respectively elastically support the first, second, and third rods 215*a*, 215*b*, and 215*c*.

While the first, second, and third elastic members 225*a*, 225*b*, and 225*c* are compressed based on the rotation position of the cam 210, a first valve 220*a*, a second valve 220*b*, and a third valve 220*c* respectively mounted to the first, second, and third rods 215*a*, 215*b*, and 215*c* may open and close a first coolant passage 230*a*, a second coolant passage 230*b*, and a third coolant passage 230*c*. In particular, opening rates of each passage 230*a*, 230*b*, and 230*c* may be adjusted according to the rotation position of the cam 210.

The controller 300 may be configured to receive vehicle operation conditions, (e.g., a coolant temperature, an ambient air temperature, a rotation position signal of the position sensor 24 configured to detect a rotation position of the cam 210 and so on) and may be configured to operate a motor 305 and the motor 305 may change the rotation position of the cam 210 through a gear box 310. The position sensor 24 may be a sensor configured to directly detect a rotation position of the cam 210, or the controller 300 may be configured to indirectly calculate the rotation position of the cam 210 by detecting a rotation portion of the motor 305 using a resolver (not shown). The first coolant path 230*a* may be in fluid communication with the heater 115, the second coolant path 230*b* may be in fluid communication with the radiator 130, and the third coolant path 230*c* may be in fluid communication with the engine block 100.

Figure 4:
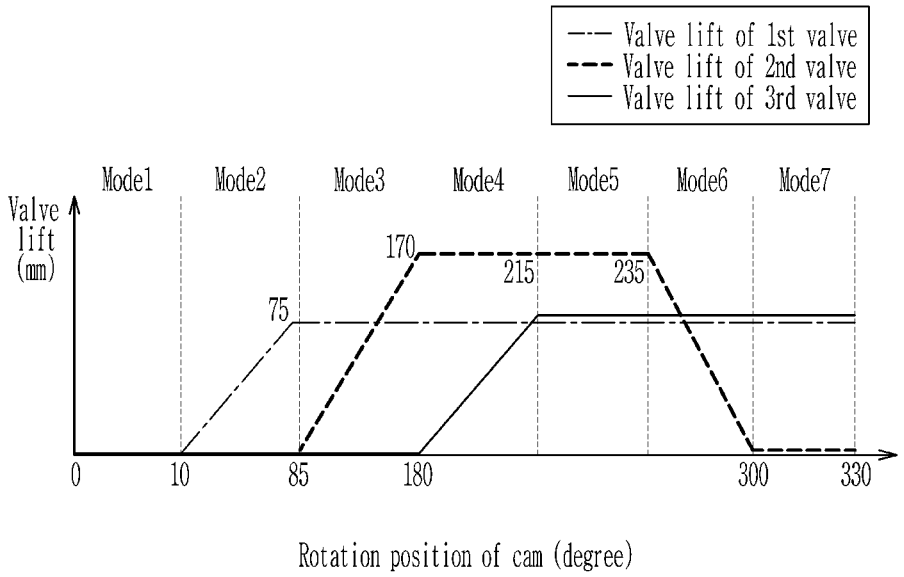
FIG. 4 is a graph of control modes of a control system applicable to a control method according to an exemplary embodiment of the present invention.

FIG. 4 is a graph of control modes of a control system applicable to a control method according to an exemplary embodiment of the present invention. In FIG. 4, the horizontal axis denotes a rotation position of the cam 210, and the vertical axis denotes valve lifts (or moving distance) of the respective valves 220*a*, 220*b*, and 220*c*. In particular, lifts of each valve 220*a*, 220*b* and 220*c* is proportional to the opening rates of the each coolant passage 230*a*, 230*b*, and 230*c*.

In the first mode, the first, second, and third coolant passages 230*a*, 230*b*, and 230*c* corresponding to the heater 115, the radiator 130 and the cylinder block 100 may be blocked and the valve lift is zero. In the second mode, the second and third coolant passages 230*b* and 230*c* corresponding to the radiator 130 and the engine block 100 may be closed, and the opening rate of the first coolant passage 230*a* corresponding to the heater 115 and the LP-EGR cooler 110 may be adjusted. In the third mode, the third coolant passage 230*c* corresponding to the engine block 100 is closed, the opening rate of the second coolant passage 230*b* corresponding to the radiator 130 may be adjusted, and the opening rate of the first coolant passage 230*a* corresponding to the heater 115 and the LP-EGR cooler 110 may be maximized.

In the fourth mode, the opening rate of the third coolant passage 230*c* corresponding to the engine block 100 may be adjusted, the opening rate of the second coolant passage 230*b* corresponding to the radiator 130 may be maximized, and the opening rate of the first coolant passage 230*a* corresponding to the heater 115 and the LP-EGR cooler 110 may be maximized. In the fifth mode, the opening rate of the third coolant passage 230*c* corresponding to the engine block 100 may be maximized, the opening rate of the second coolant passage 230*b* corresponding to the radiator 130 may be maximized, and the opening rate of the first coolant passage 230*a* corresponding to the heater 115 and the LP-EGR cooler 110 may be maximized. In the sixth mode, the opening rate of the third coolant passage 230*c* corresponding to the engine block 100 may be maximized, the opening rate of the second coolant passage 230*b* corresponding to the radiator 130 may be adjusted, and the opening rate of the first coolant passage 230*a* corresponding to the heater 115 and the LP-EGR cooler 110 may be maximized.

In the seventh mode, the opening rate of the third coolant passage 230*c* corresponding to the engine block 100 may be maximized, the second coolant passage 230*b* corresponding to the radiator 130 may be blocked, and the opening rate of the first coolant passage 230*c* corresponding to the heater 115 and the LP-EGR cooler 110 may be maximized Additionally, in the first mode, as the flow of the coolant is minimized, the temperature of the engine oil and the coolant rapidly increases in the low temperature state. The second mode is a section that is operated using the heater or the LP-EGR cooler 110 and a warm-up may be executed.

Further, the third mode is a section in which a target coolant temperature is adjusted by adjusting a cooling amount based on a driving region of the engine as a radiator cooling section. The fourth mode adjusts the temperature of the engine block 100 as a cylinder block cooling section. The fifth mode is a section used in a driving condition in which an engine heating amount is high and it may be difficult to secure the cooling amount as a maximum cooling section. In the fifth mode, a separation cooling may be released to thus secure a cooling performance of the block. The sixth mode may separately adjust a target coolant temperature of the cylinder head and the block as a cylinder block and radiator cooling section.

Figure 5:
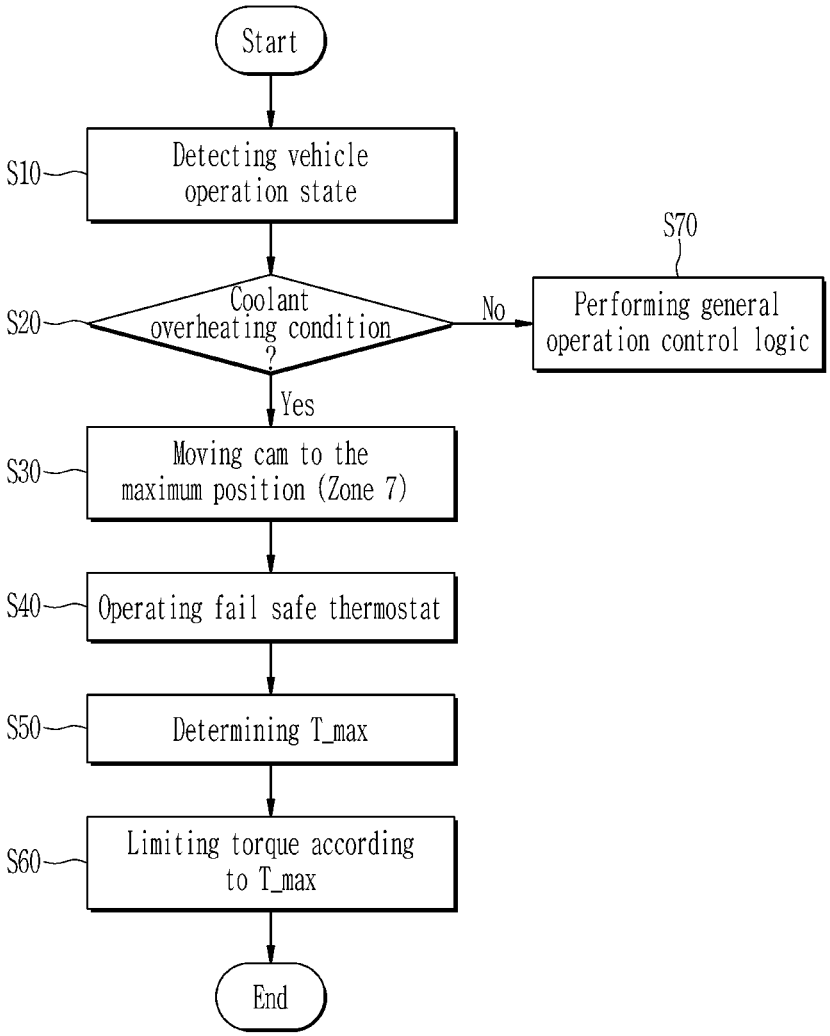
FIG. 5 is a flowchart showing a control method according to an exemplary embodiment of the present invention.

FIG. 5 is a flowchart showing a control method according to an exemplary embodiment of the present invention. Referring to FIG. 5, the controller 300 may be configured to receive the output signal of the vehicle operation state detecting portion 10 including the first coolant temperature sensor 12 and the second coolant temperature sensor 14 at step S10.

In step S20, the controller 300 may be configured to determine whether the output signals of the first coolant temperature sensor 12 and the second coolant temperature sensor 14 satisfy a predetermined coolant overheating condition. The cooling system to which the control method according to the exemplary embodiment of the present invention may be applied may independently adjust the coolant temperature of the engine block 100 and the cylinder head 105. Even when separate cooling is applied, the coolant boiling point is the same since the cooling system uses one loop. Therefore, the temperature of the coolant of the engine block 100 may increase thus causing boiling to occur, and the heat exchange element or the engine 90 may be damaged. Thus, the controller 300 may be configured to determine whether the coolant is in a condition in which a risk of boiling occurs in accordance with the output signals of the first and second coolant temperature sensors 12 and 14, and the coolant overheating condition may be set by experiment.

When the coolant overheating condition is satisfied, the controller 300 may be configured to operate the coolant control valve unit 125 to move the cam 210 to the maximum position in operation S30. The moving the cam 210 to the maximum position may be performed by the controller 300 configured to output the movement signal of the cam 210 for a predetermined period of time. The set time may be set to a time required for the cam 210 to move to the maximum position according to an output signal of the controller 300.

The overheating of the cooling system may occur due to various causes. For example, the cause may be a broken or shorted line of the position sensor 24, a short circuit or short circuit of the motor 305, a damage to the motor 305, the cam 210 may be stuck, or the like. When the position sensor 24 malfunctions, an error may occur with respect to the current position of the cam 210. Accordingly, the controller 300 may be configured to operate the coolant control valve unit 125 to move the cam 210 to the maximum position.

Referring to FIG. 4, the maximum position may be a position where the first coolant passage 230*a* and the third coolant passage 230*c* are fully opened, that is the seventh mode. When the coolant control valve unit 125 operates in the seventh mode, the third coolant passage 230*c* in communication with the engine block 100 may be opened and coolant may be supplied to the engine block 100 and the cylinder head 105. At this time, the fail-safe thermostat 330 may be opened by the high temperature coolant.

In particular, the fail-safe thermostat 330 may be an electrical thermostat and the controller 300 may be configured to operate the fail safe thermostat 330 when the coolant overheating condition is satisfied (S40). When the fail safe thermostat 330 is opened, coolant may be cooled through the radiator 130. When the controller 300 transmits an operation signal to the motor 305, the motor 305 may be unable to be operated due to a failure of the motor 305 or a foreign substance in the rotation direction of the cam 210. Accordingly, the third coolant passage 230*c* may not open and the engine 90, particularly the engine block 100, may be overheated.

Additionally, even when the fail-safe thermostat 330 is opened, the engine 90 may be overheated. Accordingly, the controller 300 may be configured to determine the control temperature T_max based on the output signals of the first and second coolant temperature sensors 12 and 14 (S50), and output the determined control temperature T_max for the operation of the injector 340 to be restricted (S60). The torque of the engine may be limited or restricted based on the operation restriction of the injector 340, and thus, the engine 90 may continue to be operated and the engine 90 may be prevented from overheating.

Furthermore, the controller 300 may be configured to operate the coolant control valve unit 125 according to the first mode to the seventh mode described above, that is, the general operation control logic may be performed (S70). The controller 300 may be configured to determine whether the coolant overheating condition is satisfied based on an output signal of the vehicle operation state detecting portion 10 while operating the coolant control valve unit 125 according to general operation control logic. When the coolant overheating condition is satisfied, the control method according to the example may be performed repeatedly.

Figure 6:
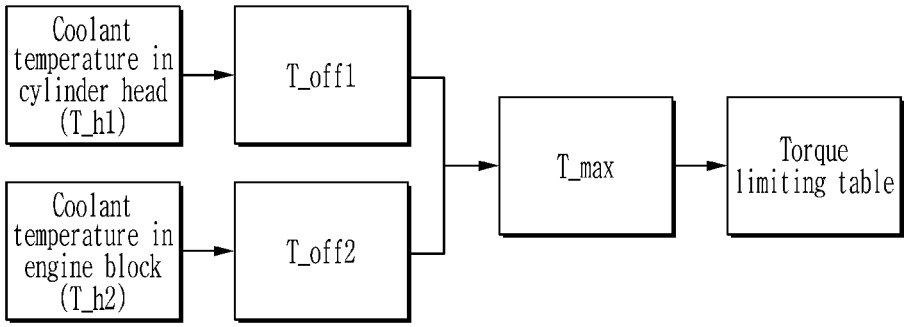
FIG. 6 is a block diagram illustrating a comparison of coolant temperature in a control method according to an exemplary embodiment of the present invention.

FIG. 6 is a block diagram illustrating a comparison of coolant temperature in a control method according to an exemplary embodiment of the present invention. Referring to FIG. 6, the controller 300 may be configured to receive the present output signals T_h1 and T_h2 of the first coolant temperature sensor 12 and the second coolant temperature sensor 14. Additionally, the controller 300 may be configured to determine a first correction temperature T_off1 and a second correction temperature T_off2 by subtracting a first and second offset values from the output signals T_h1 and T_h2 of the first coolant temperature sensor 12 and the second coolant temperature sensor 14 respectively.

The cooling system to which the control method according to the exemplary embodiment of the present invention may be applied, may independently adjust the coolant temperature of the engine block 100 and the cylinder head 105 and adjust the temperature of the engine block 100 and the cylinder head 105 with a difference of approximately 10° C. Since the cylinder head 105 and the engine block 100 have different control temperatures, the offset values may be applied differently to the coolant temperature that enters the maximum torque limit to maintain the engine protection and the appropriate engine torque.

For example, the first offset value may be about 0° C. and the second offset value may be about 10° C. The controller 300 may be configured to compare the first and second correction temperatures T_off1 and T_off2 and set a greater correction temperature to the control temperature T_max to operate the injector 340. The operation limitation of the injector 340 may be performed by applying the control temperature T_max to a predetermined table.

FIG. 7 is a torque limiting table that may be applied to a control method according to the exemplary embodiment of the present invention. For example, when the control temperature T_max is about 120° C., the limit torque is set to 100%, and when the control temperature T_max is about 125° C., the limit torque may be set to 80%. Particularly, limit torque may be defined as a limit value for the maximum torque of the engine 90. The control temperature and the proposed torque shown in the table are shown for the sake of understanding, but are not limited thereto.

As described above, when the over-temperature of the coolant is detected during operation of the vehicle, the cooling system control method according to the exemplary embodiment of the present invention may be performed. When the abnormality of the cooling system is detected by performing the general error diagnosis control logic, the abnormality may be determined to correspond to the coolant overheating condition, and the cooling system control method according to the exemplary embodiment of the present invention may be performed to execute engine protection and the engine torque may properly be limited. In addition, even when the second coolant temperature sensor 14 is affected by the vibration of the engine and is exposed to a relatively high temperature, the cooling system control method according to the exemplary embodiment of the present invention may be performed to protect the engine and maintain proper engine torque may be possible.

While this invention has been described in connection with what is presently considered to be exemplary embodiments, it is to be understood that the invention is not limited to the disclosed exemplary embodiments, but, on the contrary, is intended to cover various modifications and equivalent arrangements included within the spirit and scope of the appended claims.

What is claimed is:

1. A control method for a cooling system for an engine, comprising:

determining, by a controller, whether output signals of a first coolant temperature sensor and a second coolant temperature sensor satisfied a predetermined coolant overheating condition, wherein the first coolant temperature sensor and the second coolant temperature sensor are part of a vehicle operation state detecting portion of the cooling system;

operating, by the controller, a coolant control valve unit of the cooling system to move a cam of the coolant control valve unit to a maximum position when the predetermined coolant overheating condition is satisfied, wherein the cam adjusts opening rates of a first coolant passage through which the coolant distributed to a heater flows, a second coolant passage through which the coolant distributed to a radiator flows and a third coolant passage through which the coolant discharged from a cylinder block flows;

determining, by the controller, a control temperature according to an output signal of the first coolant temperature sensor and the second coolant temperature sensor;

limiting, by the controller, an operation of an injector of the cooling system for the engine according to the determined control temperature, the operation of the injector being controlled so as to limit torque;

determining, by the controller, a first correction temperature and a second correction temperature by subtracting first and second offset values from the output signals of the first coolant temperature sensor and the second coolant temperature sensor, respectively; and comparing, by the controller, the first and second correction temperatures and setting a greater correction temperature to the control temperature.

2. The control method of claim 1, wherein the maximum position is a position where the first coolant passage and the third coolant passage are fully opened.

3. The control method of claim 1, wherein the operation limitation of the injector is performed by applying the control temperature to a predetermined table.

4. The control method of claim 1, wherein the coolant control valve unit is equipped with a fail-safe thermostat for selectively discharging coolant to the radiator.

5. The control method of claim 4, wherein the fail-safe thermostat is an electrical thermostat.

6. The control method of claim 5, further comprising:

opening, by the controller, the fail-safe thermostat by operating the fail-safe thermostat when the coolant overheating condition is satisfied.

7. The control method of claim 1, wherein the moving of the cam to the maximum position is performed by outputting the movement signal of the cam for a predetermined period of time.

8. A cooling system for an engine, comprising:

a coolant control valve unit having a cam that adjusts opening rates of a first coolant passage through which the coolant distributed to a heater flows, a second coolant passage through which the coolant distributed to a radiator flows and a third coolant passage through which the coolant discharged from a cylinder block flows;

a vehicle operation state detecting portion including:

a first coolant temperature sensor configured to measure the temperature of the coolant flowing through the cylinder head and output a corresponding signal;

a second coolant temperature sensor configured to measure the temperature of the coolant flowing through the cylinder block; and a position sensor configured to measure a rotation of the cam and output a corresponding signal;

an injector for the engine; and a controller configured to operate the coolant control valve unit and the injector according to output signals of the vehicle operation state detecting portion, wherein operation of the injector is controlled so as to limit torque, and the controller is configured to:

determine a first correction temperature and a second correction temperature by subtracting a first and second offset values from the output signals of the first coolant temperature sensor and the second coolant temperature sensor, respectively; and compare the first and second correction temperatures and set a greater correction temperature to the control temperature.

9. The cooling system of claim 8, wherein the maximum position is a position where the first coolant passage and the third coolant passage are fully opened.

10. The cooling system of claim 8, wherein the injector is limited by applying the control temperature to a predetermined table.

11. The cooling system of claim 8, wherein the coolant control valve unit is equipped with a fail-safe thermostat for selectively discharging coolant to the radiator.

12. The cooling system of claim 11, wherein the fail-safe thermostat is an electrical thermostat.

13. The cooling system of claim 12, wherein the controller is further configured to:

open the fail-safe thermostat by operating the fail-safe thermostat when the coolant overheating condition is satisfied.

14. The cooling system of claim 8, wherein the controller is configured to move the cam to the maximum position by outputting the movement signal of the cam for a predetermined period of time.

* * * * *